US005181983A

United States Patent [19]

Sakai

[11] Patent Number: 5,181,983

[45] Date of Patent: Jan. 26, 1993

[54] ADHESIVE TAPE CUTTING DEVICE

[75] Inventor: Kikuo Sakai, Tokyo, Japan

[73] Assignee: Shinwa Denshi Kabushiki Kaisha, Tokyo, Japan

[21] Appl. No.: 717,493

[22] Filed: Jun. 19, 1991

[30] Foreign Application Priority Data

Jun. 19, 1990 [JP] Japan ..... 2-64557

[51] Int. Cl.[5] ..... B32B 31/00

[52] U.S. Cl. ..... 156/523; 156/576; 156/577; 156/579; 225/72; 225/23

[58] Field of Search ..... 156/523, 576, 577, 579; 225/23, 77, 80, 72

[56] References Cited

U.S. PATENT DOCUMENTS

| | | | |
|---|---|---|---|
| 3,027,292 | 3/1962 | Rothenberger | 156/523 X |
| 3,306,806 | 2/1967 | Seropian | 156/523 |
| 4,253,905 | 3/1981 | Regan | 156/577 X |
| 4,608,116 | 8/1986 | Braselton | 156/577 X |

*Primary Examiner*—David A. Simmons
*Assistant Examiner*—Mark A. Osele
*Attorney, Agent, or Firm*—Cushman, Darby & Cushman

[57] ABSTRACT

An adhesive tape cutting device rotatably supporting an adhesive tape roll, which is adapted to adhere an adhesive tape of a desired length on a surface of an object, and is capable of reliably and repeatedly delivering the next tip of the tape from the adhesive tape roll for the next adhesion operation. The device comprises a lever movably mounted on the base member; a pressing surface portion, which is formed on a bottom portion of the lever for pressing the upper surface of the adhesive tape at the time of adhering the tape; an arm member provided on a portion of the lever for temporarily fixing a delivered portion of the tape on a temporary fixing member mounted on the base member; and a blade mounted on the lever for cutting a free end portion of the tape. It is possible to perform operations of adhering and cutting by simply displacing the lever relative to a guiding edge formed on the bottom of the base member.

8 Claims, 5 Drawing Sheets

ADHESIVE TAPE CUTTING DEVICE

BACKGROUND OF THE INVENTION (a) Field of the Invention

This invention relates to an adhesive tape cutting device which is adapted to adhere an adhesive tape of a desired length on a surface of an object after unrolling the desired length of the tape from an adhesive tape roll, and then cutting the desired length of the tape.

(b) Description of the Prior Art

Conventionally, adhesive tape unrolling (or delivery) devices of various kinds of construction have been proposed. However, some of the conventional adhesive tape unrolling devices have drawbacks such that they are more likely to spoil the surface of an object to be adhered as the cutter thereof comes in touch with the surface to be adhered. Some other kinds of the conventional adhesive tape unrolling devices have drawbacks such that they easily get into trouble in unrolling the adhesive tape. Still some other kinds of the conventional adhesive tape unrolling devices are so complicated in structure that they easily break down.

SUMMARY OF THE INVENTION

This invention has been made in view of the circumstances as mentioned above. Therefore, an object of this invention is to provide an adhesive tape cutting device, which is, in spite of its simple construction, capable of reliably cutting the adhesive tape which is unrolled from an adhesive tape roll without causing a damage to the surface to which the tape is adhered, and also capable of reliably and repeatedly unrolling and delivering the next tip of the tape from the adhesive tape roll after the adhering of a desired length of the tape on an intended surface is accomplished.

In order to realize above objects, this invention has taken the following measures.

(a) A holding member for holding an adhesive tape roll is mounted on a base member in such a way that the adhesive tape can be freely unrolled and delivered therefrom;

(b) A delivery guiding member for guiding the adhesive tape which has been drawn out from the tape roll toward the direction of adhering the tape is mounted on the base member;

(c) A movable member is movably mounted on the base member in such a manner that the movable member can be advanced, approach to, or retreated to be spaced apart from the holding member;

(d) A pressing surface portion is formed on a portion of the movable member which is located near the delivery guiding member for pressing the upper surface of the adhesive tape which has been drawn out from the tape roll through the delivery guiding member;

(e) An arm member is provided on a portion of the movable member which can be displaced from a position in which the arm member is set apart from the portion of the adhesive tape which is unrolled and stretched between the tape roll and the delivery guiding member to a position in which the arm member is advanced to intersect with and push the unrolled and stretched portion of the tape;

(f) The base member is provided with a temporary fixing member which is capable of temporarily adhering thereon a portion of the adhesive tape stretched at the upstream of the tape delivery guide (hereinafter referred to as an inner unrolled portion) as this portion of the adhesive tape is displaced and attached thereon by the pushing of the arm member;

(g) A blade is mounted on the movable member, which is adapted to cut a free end portion of the adhesive tape stretched and disposed between an unrolled portion of the adhesive tape which is delivered at the downstream of the tape delivery guide and pressed by the pressing surface and a portion of the inner unrolled portion which is fixed by the temporary fixing member.

Thus, according to this invention, there is provided an adhesive tape cutting device comprising:

a holding member for holding an adhesive tape roll, which is mounted on a base member in such a way that the adhesive tape can be freely unrolled and delivered therefrom;

a delivery guiding member mounted on the base member for guiding the adhesive tape which has been drawn out from the tape roll toward the direction of adhering the tape;

a movable member is movably mounted on the base member in such a manner that the movable member can be advanced, approach to, or retreated to be spaced apart from the holding member;

a pressing surface portion, which is formed on a bottom portion of the movable member for pressing the upper surface of the adhesive tape which has been drawn out from the tape roll through the delivery guiding member;

an arm member provided on a portion of the movable member, which can be displaced from a position in which the arm member is set apart from the portion of the adhesive tape which is unrolled and stretched between the tape roll and the delivery guiding member to a position in which the arm member is advanced to intersect with and push the unrolled and stretched portion of the tape;

a temporary fixing member mounted on the base member, which is capable of temporarily adhering thereon a portion of the adhesive tape stretched at the upstream of the tape delivery guide when this portion of the adhesive tape is displaced and attached thereon by the pushing of the arm member; and a blade mounted on the movable member, which is adapted to cut a free end portion of the adhesive tape stretched and disposed between an unrolled portion of the adhesive tape which is delivered at the downstream of the tape delivery guide and pressed by the pressing surface portion and a portion of the adhesive tape which is stretched at the upstream of the tape delivery guide and fixed by the temporary fixing member.

According to the adhesive tape cutting device of this invention, it is possible to deliver the tip portion of the adhesive tape to such an extent that the tip portion of the adhesive tape can be overlapped by the distal end portion of the flat pressing surface portion of the movable member.

Therefore, when the linear guiding edge portion of the base member is forced to press on a surface of a material to be adhered with an adhesive tape, the tip portion of the movable member is spontaneously forced to contact with the surface of the material, thereby taking a position wherein the pressing surface portion of the movable member becomes in parallel with the linear guiding edge portion, with the pressing surface portion of the movable member being disposed in flash with or protruded downward beyond the lower surface of the linear guiding edge portion.

As a result, the tip portion of the tape which has been delivered out of the delivering guide member is pressed on the surface of the material by the pressing surface portion of the movable member. Therefore, when the case is moved in the direction of unrolling the adhesive tape from the tape roll, while pressing the flat pressing surface portion of the movable member on the upper surface of the tape, any desired length of the tape can be adhered on the surface of the material.

Then, when the linear guiding edge portion of the case is rotated to some extent, while keeping the movable member in a horizontal state, to take the cutting position wherein the proximal end portion of the movable member is widely exposed out of the linear guiding edge portion, the proximal end of the adhesive tape being adhered will be cut by the blade.

After cutting of the tape, the movable member is rotated to take the stand-by position, wherein the proximal end portion of the pressing surface portion of the movable member is retreated to the inner side of the linear guiding edge, thereby leaving the tip of the adhesive tape free for the next use.

When the movable member is rotated to take the cutting position, as mentioned above, the arm member is also displaced to intersect with and push the unrolled portion of the adhesive tape thereby deforming and adhering this unrolled portion onto the temporary fixing member.

Accordingly, as the cutting portion of the adhesive tape is being stretched between the temporary fixing member and the pressing surface portion of the movable member, only a slight further rotational movement of the movable member will cause this portion of the tape to be easily cut by the blade.

DESCRIPTION OF THE PREFERRED EMBODIMENTS

This invention will be further explained with reference to the following embodiments, wherein an adhesive tape cutting device of this invention is housed in a case.

Figure 1:
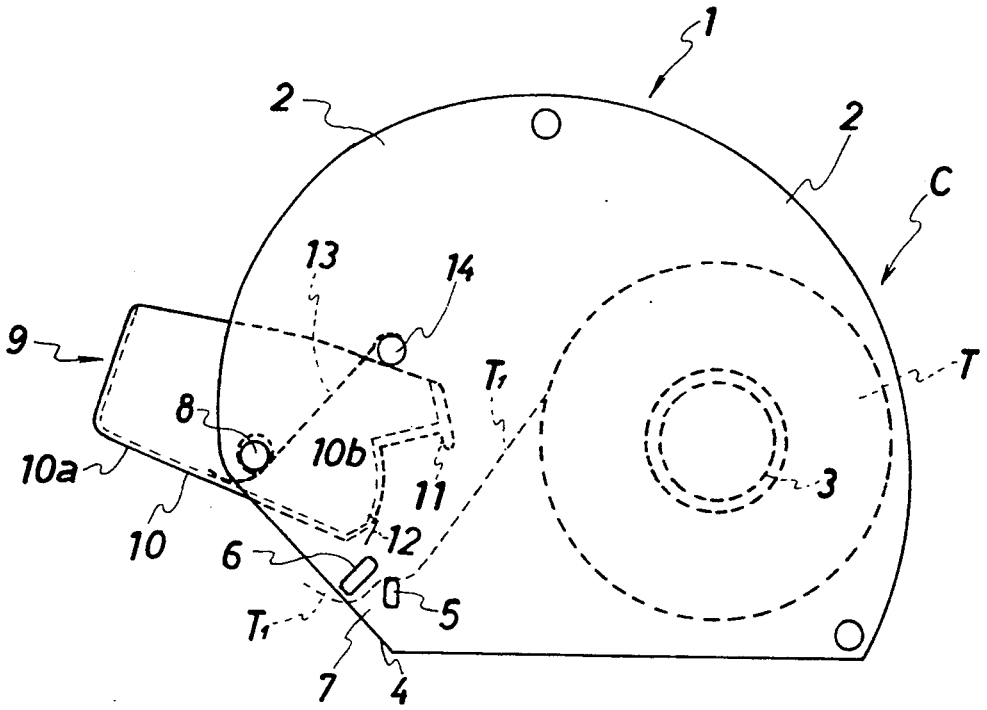
FIG. 1 shows a side view of an adhesive tape cutting device in a stand-by position according to this invention.

FIG. 1 shows a side view of an adhesive tape cutting device in a stand-by position (nonuse state), wherein a case 1 comprises a self-sustaining table 1*a*, and a pair of left and right symmetrical wall components 2, each having an arc-shaped wall portion, thereby forming a box-like structure to detachably mount therebetween an adhesive tape roll R.

One of the wall components 2 is provided with a supporting cylinder 3 on its inner wall for detachably and rotatably supporting the adhesive tape roll R.

The wall components 2 are respectively provided with a flat bottom 2*a*, and with a guiding edge portion 4 formed contiguous to the flat bottom 2*a* and inclined upward from the flat bottom 2*a*.

Along the guiding edge portion 4 near the boundary portion between the flat bottom 2*a* and the guiding edge portion 4 are disposed side by side a temporary fixing member 5 and a delivery guiding member 6 with a slight space formed therebetween.

This slight space functions as a delivering outlet 7 for an adhesive tape which has been withdrawn or unrolled from the adhesive tape roll R.

For the convenience of explanation, a portion of the adhesive tape which extends from the adhesive tape roll R to the delivery guide 6 is referred to as an inner delivered tape portion T1, while a portion of the adhesive tape which extends from the delivery guide 6 to the free end of the adhesive tape is referred to as an outer delivered tape portion T2.

The temporary fixing member 5 is positioned facing the adhesive layer-coated side (back side) of the inner delivered tape portion T1, while delivery guiding member 6 is positioned facing the front side of the outer delivered tape portion T2.

In the vicinity of the upper edge portion of the guiding edge portion 4 of the wall components 2 (an edge portion remote from the flat bottom) is disposed a shaft 8, both ends of which are fixed to the wall components 2. On this shaft 8 is pivotally mounted a movable member 9, whose middle portion is pierced by the shaft 8.

This movable member 9 is of a box-like shape with the upper portion thereof being opened, and has a flat bottom surface extending from back to forth thereby forming a pressing surface 10, the width thereof being wider than the width of the adhesive tape.

It is sufficient for the pressing surface 10 to be formed at least at the portion which is located to the rear of the shaft 8 of the movable member 9. However, in this embodiment, the pressing surface 10 is formed on the entire region of the bottom.

Out of the bottom surface of the movable member 9, a forward portion 10*a* which is located forward of the shaft 8 in the direction of delivering the adhesive tape extends out of the pair of wall components 2, and a rearward portion 10*b* (essentially, a pressing surface) which is located rearward of the shaft 8 in the direction of delivering the adhesive tape extends to a position near the delivering guide member 6.

Figure 2:
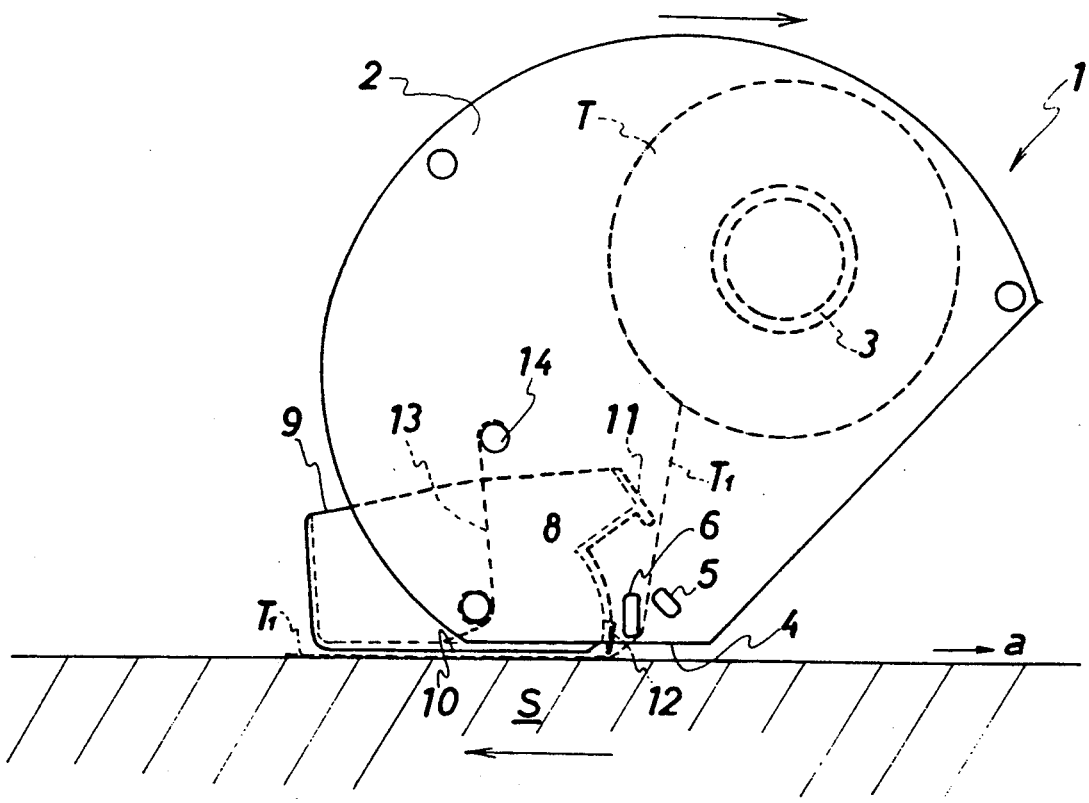
FIG. 2 shows a side view of the adhesive tape cutting device in a pressing position.

This movable member 9 is mounted in such a manner that when this movable member 9 is rotated to such an extent that the pressing surface 10 becomes in parallel with the guiding edge portion 4, the bottom portion of the pressing surface 10 is slightly exposed out of the bottom of the guiding edge portion 4 as shown in FIG. 2.

Meanwhile, an arm member 11 is attached to a portion of the movable member 9, or to the upper portion of the rearward portion 10*b*.

Figure 3:
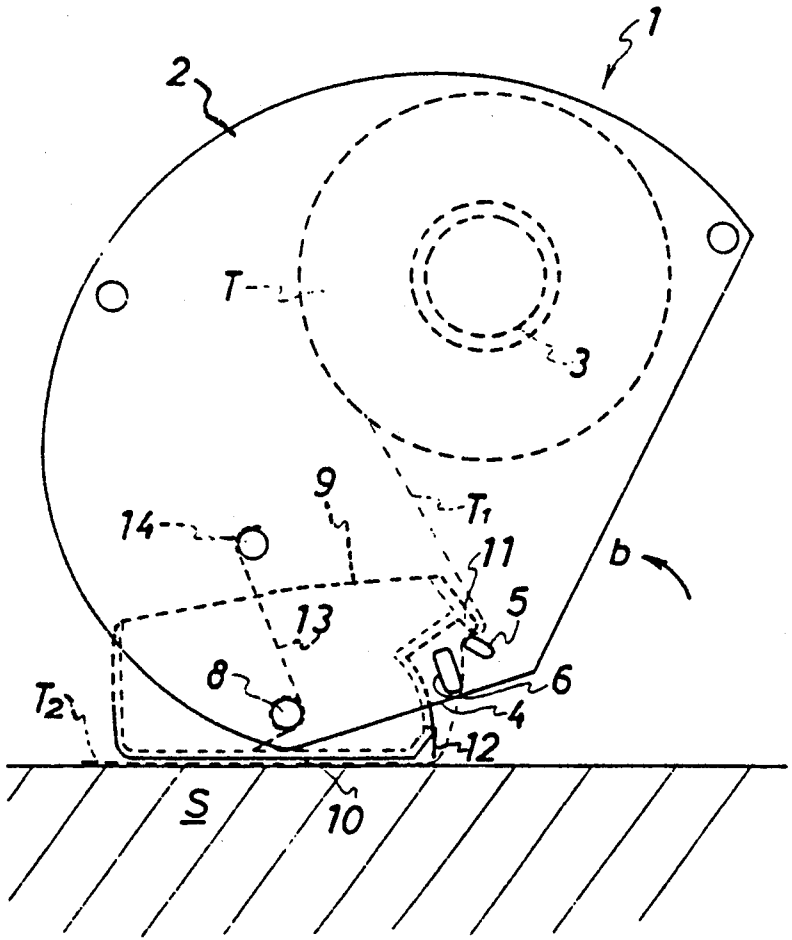
FIG. 3 shows a side view of the adhesive tape cutting device in a cutting position.

The tip portion of this arm member 11 is, in this embodiment shown in FIG. 3, adapted to push a middle portion of the inner delivered tape portion T1 and adhere it to the temporary fixing member 5 as the movable member 9 is rotated to a prescribed angle.

A blade 12 is attached to a portion of the movable member 9 near the rearward portion 10*b* of the pressing surface portion 10 of the movable member 9 in such a manner that the edge thereof does not extend beyond the pressing surface portion 10.

In this embodiment, the proximal end portion of the blade 12 is fastened at the middle portion of the rear surface of the movable member 9, and the edge of the blade 12 is slightly spaced apart from the rearward portion 10*b* of the pressing surface portion 10 so as to make it possible to cut the adhesive tape.

In order to keep the rearward portion 10*b* of the pressing surface 10 of the movable member 9 housed within the pair of the wall components 2 in the normal state (i.e. nonuse state) as shown in FIG. 1, a spring 13 is mounted between the shaft 8 and the shaft 14.

The shaft 14 also functions as a stopper for restricting the rotation of the movable member 9 to a predetermined range.

The method of using the adhesive tape cutting device of this invention as constructed above will be explained below.

First, the linear guiding edge portion 4 is pressed onto a surface S of a material to which the adhesive tape is to be adhered, while grasping the pair of the wall components 2 in hand.

At this moment, the movable member 9 is rotated such that the rearward portion 10*b* of the pressing surface portion 10 moves outward against the elastic force of the spring 13 as shown in FIG. 2, thereby causing the pressing surface portion 10 to come in contact with the surface S, and at the same time causing a free end of the outer delivered tape portion T2, which has been delivered in advance from a space between the temporary fixing member 5 and the delivering guide member 6, to be pressed and adhered on the surface S by the pressure of the pressing surface portion 10.

While keeping the device in this state, the case 1 is advanced in the direction of "a". As a result, the tape T is pulled in the direction of delivery to peel off the portion of the tape which has been adhered onto the temporary fixing member 5 to finally set it free therefrom thereby allowing the adhesive tape roll to be rotated.

When the case 1 is further moved in parallel with the surface S in the direction of "a", the tape T of the tape roll is further unrolled to deliver the outer delivered tape portion T2, which is continuously pressed by the pressing surface 10 thereby adhering a desired length of the adhesive tape on the surface S.

When the adhering operation is finished, the wall components 2 are rotated in the direction of "b", while keeping the pressing surface 10 of the movable member 9 pressed onto the surface S, thereby causing the inner delivered tape portion T1 to be bent by the arm member 11 and to adhere it onto the temporary fixing member 5.

At this moment, the outer delivered tape portion T2 is pressed and adhered by the pressing surface portion 10, and the inner delivered tape portion T1 is pressed and adhered to the temporary fixing member 5 by the arm member 11, thereby stretching the portion of the adhesive tape extending therebetween.

Then, the wall components 2 are slightly rotated further, to cause the blade 12 to push and cut this stretched portion of the outer delivered tape portion T2.

After finishing the operations of adhering and cutting the adhesive tape, the case 1 is allowed to be separated from the surface S, thereby causing the movable member 9 to return to its original stand-by position as shown in FIG. 1 due to the elastic force of the spring 13. Since a portion of the inner delivered tape portion T1 is kept adhered onto the temporary fixing member 5, the tip portion of the outer delivered tape portion T2 does not retreat into the wall components 2, but remains as being delivered out of the delivery guiding member 4.

As a result, in the next adhering operation, the rearward portion 10*b* of the pressing surface 10 of the movable member 9 can take hold of this free tip portion of the outer delivered tape portion T2, and press it onto a surface to be adhered with the adhesive tape.

As a material for the adhesive tape, in addition to an ordinary cellophane tape as explained above, any adhesive tape in the form of a roll, such as double-faced tape, gum tape, cloth tape and the like adhesive tape can be used in this invention.

The above described embodiment employs a pair of wall components having a flat bottom surface. However, it is also possible to employ other self-sustaining means instead of the flat bottom surface.

Figure 4:
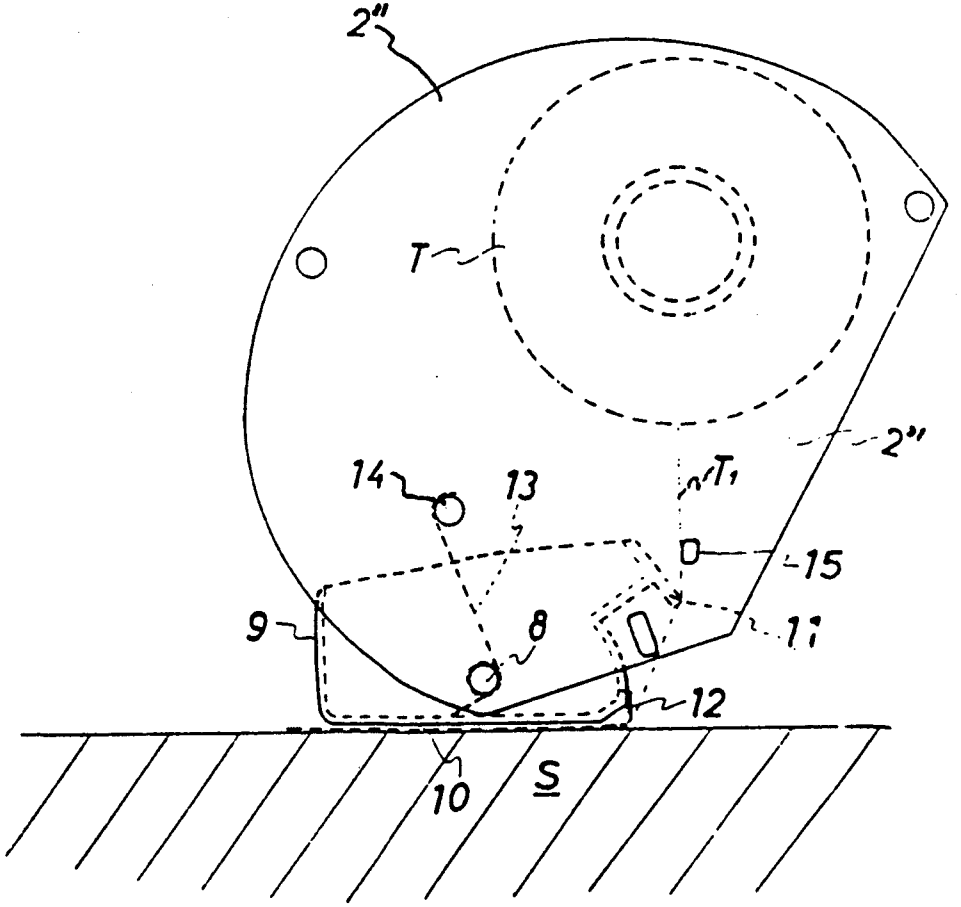
FIG. 4 shows a side view of anther embodiment of an adhesive tape cutting device in a cutting position wherein arrangement of the temporary fixing member is modified.

FIG. 4 explains another embodiment, wherein a temporary fixing member 15 is mounted on an upper portion of a box-like component 2''.

According to this embodiment, the arm member 11 causes the deformation of a portion of the tape T1, and allows the deformed tape to be adhered onto the temporary fixing member 15, thereby stretching the tape T1.

Other constructions are the same as explained above.

Figure 5:
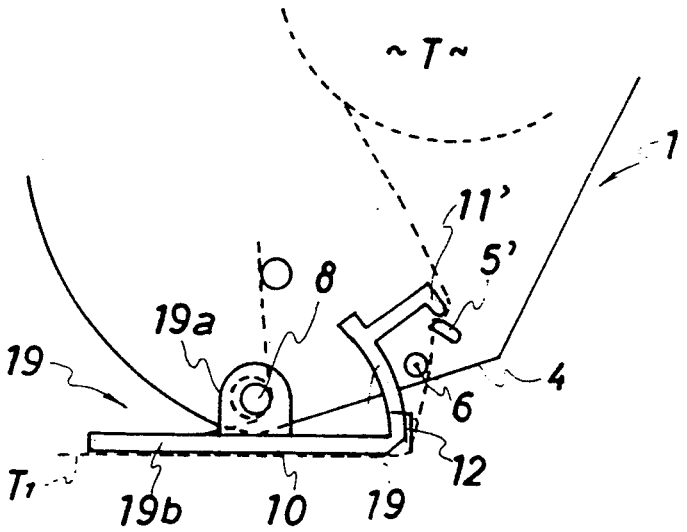
FIG. 5 shows a side view of a main portion of another embodiment of an adhesive tape cutting device in a cutting position wherein arrangement of the movable member is modified.

FIG. 5 depicts another embodiment, wherein a movable member 19 is provided with a bracket 19*a*, and a plate 19*b* which is rotatably mounted on the shaft 8 is provided with the pressing surface portion 10. The movable member 19 further comprises a standing portion 19*c* standing in an arc-like shape from the rear side of the pressing surface portion 10 so as to avoid a collision with the delivery guiding member (a guide roller) 6' during its rotation, and a tape fixing member 11' extending backward from the standing portion 19*c*, which is adapted to contact the temporary adhering member 5'.

The functions and operation of this embodiment are almost the same as explained above.

Figure 6:
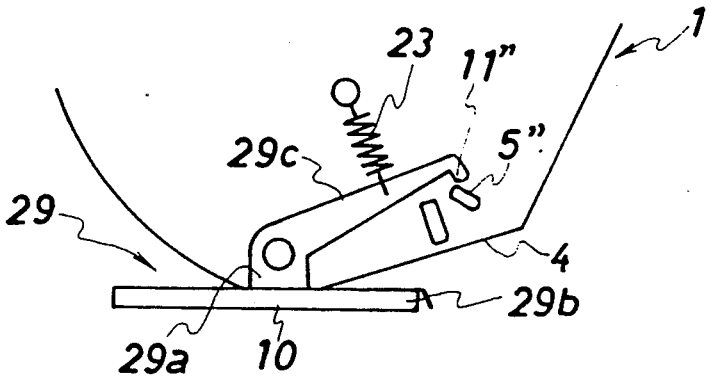
FIG. 6 shows a side view of a main portion of further another embodiment of an adhesive tape cutting device in a cutting position wherein arrangement of the movable member is further modified.

FIG. 6 explains further another embodiment, wherein a movable member 29 is modified.

This movable member 29 comprises a plate 29*b* having a pressing surface portion 10, and a bracket 29*a* provided with an arm member 29c extending rearward therefrom, and, at the forward end portion of the arm member 29c, a tape fixing member 11, which is adapted to contact the temporary adhering member 5''.

A coil spring 23 is employed as an energizing means for the movable member 29.

The functions and operation of this embodiment are almost the same as explained above.

The direction of advancing the pressing operation by the movable member may be reversed from the above embodiments.

Further, the pressing surface portion may be of a curved surface, or of a roller.

Moreover, the delivery guiding member may guide delivering tape by utilizing a rear corner of a lower part of the movable member.

Figure 8:
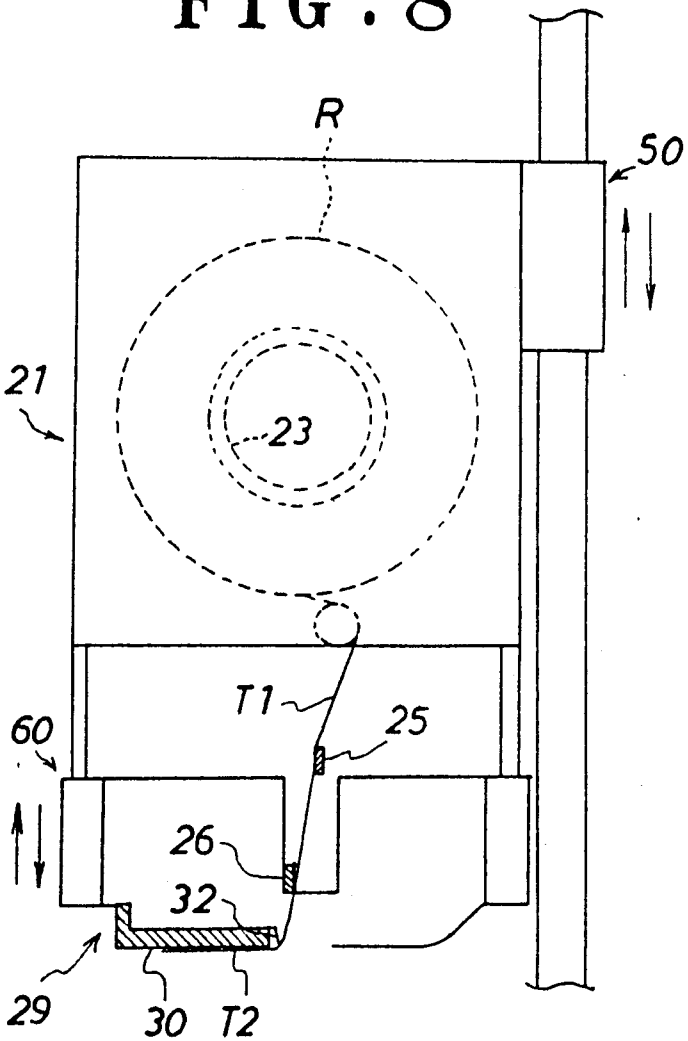
FIG. 8 is a cross-sectional view of an adhesive tape cutting device shown in FIG. 7, which is in a cutting position.
Figure 7:
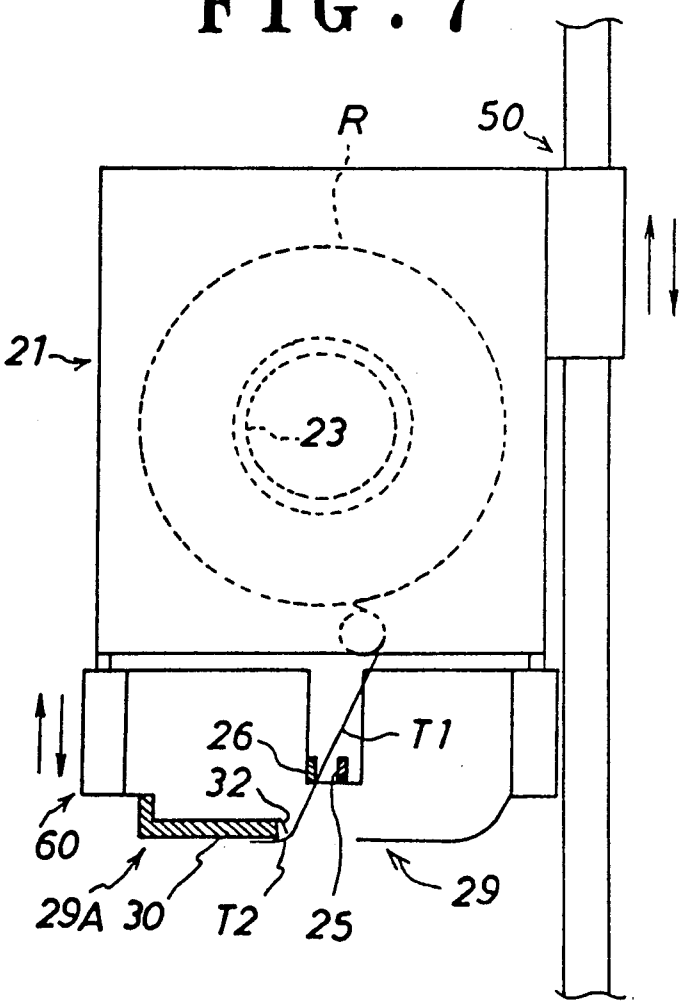
FIG. 7 is a cross-sectional view of an adhesive tape cutting device wherein operation the movable member is modified.

In the embodiments shown in FIGS. 7 and 8, the adhesive tape cutting device is disposed over a conveying apparatus.

This apparatus comprises a base member 21 which is adapted to be moved up and down by means of a lifting apparatus 50 and sustains a holding member 23 for holding an adhesive tape roll, and a movable member 29 which is mounted in such a manner that the movable member can be lifted up to approach to the base member 21 or descended down to be spaced apart from the base member 21.

Accordingly, the movable member 29 can be moved up and down relative to the base member 21 thereby enlarging or shortening the space between the movable member 29 and the adhesive tape roll R.

This up and down movement 60 of the movable member 29 relative to the base member 21 can be realized by the following construction.

For example, a screw shaft is rotatably mounted on the base member 21 in such a manner that the screw shaft can be rotated by means of a motor, and a receiving member such as a nut which is adapted to be engaged with the screw shaft is mounted on the movable member 29 so that the movable member 29 can be moved up and down through the rotation of the screw shaft.

The movable member 29 may be also connected to a rod of an air cylinder mounted on the base member thereby allowing the movable member to be moved up and down.

In this embodiment, a projected portion 26 which is integrally attached to the movable member 29 functions also as a delivery guiding member and as an arm member.

When the movable member 29 is ascended to approach the adhesive tape roll, the projected portion 26 functioning as an arm member is set at the same level as that of the temporary fixing member 25 which is fixed to the base member 21, and therefore the inner delivered tape portion T1 passing therebetween can be withdrawn without contacting the temporary fixing member 25.

Therefore, when the base member 21 is lowered down together with the movable member 29 by the lifting apparatus 50, the outer delivered tape portion T2 is pressed and adhered onto the surface of a material to be adhered with the tape by the pressing surface portion 30 which is formed at the lower surface of the forward block 29A of the movable member 29.

By keeping this pressing operation at a desired length of time, a desired length of the adhesive tape can be adhered on the surface of the material which is continuously fed by a conveying apparatus.

In cutting the adhesive tape, the movable member 29 is lowered relative to the base member 21 to raise only the base member 21 thus moving the movable member 29 in the direction remote from the adhesive tape roll R.

In this manner, the projected portion 26 functioning as an arm is displaced downward toward the temporary fixing member 25. Therefore, a portion of the inner delivered tape portion T1 being passed through therebetween is forced to be bent and to be adhered on the temporary fixing member 25.

Then, only the base member 21 is allowed to raise while keeping the movable member 29 as it is (or the movable member 29 is relatively lowered), thereby causing the blade 32 to push onto the adhesive tape being stretched (or tensioned) and to cut the tape.

After cutting the tape in this manner, the movable member 29 is allowed to raise to approach the adhesive tape roll R, and the tip portion of the tape resulted from the cutting is allowed to extrude downward from the pressing surface of the movable member 29, thereby preparing for the next adhering operation.

Figure 10:
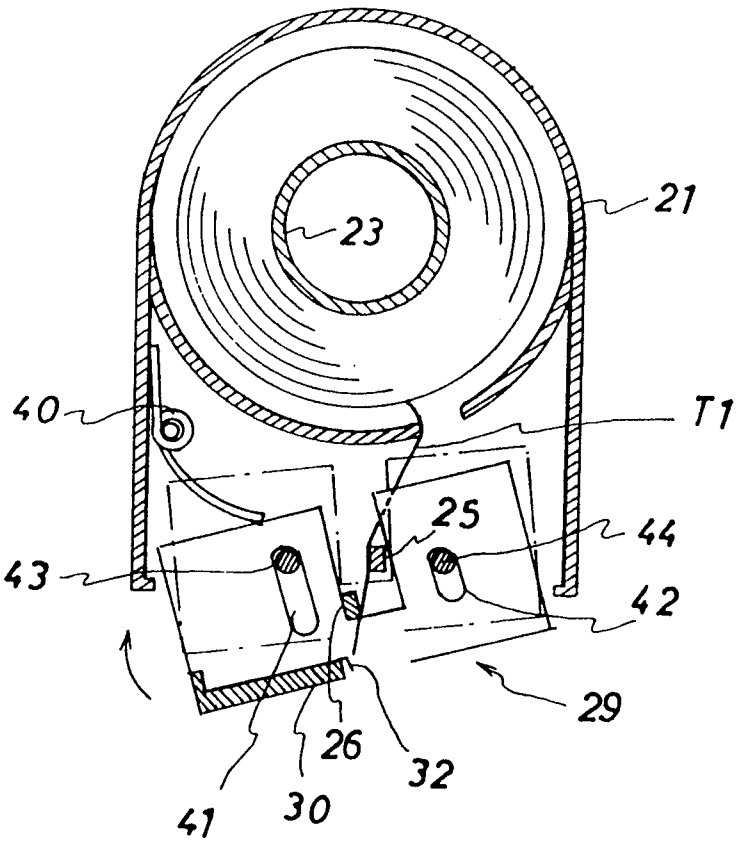
FIG. 10 is a cross-sectional view of the embodiment shown in FIG. 9 of adhesive tape cutting device wherein the movable member is tilted simultaneously with the up and down movement of the movable member.
Figure 9:
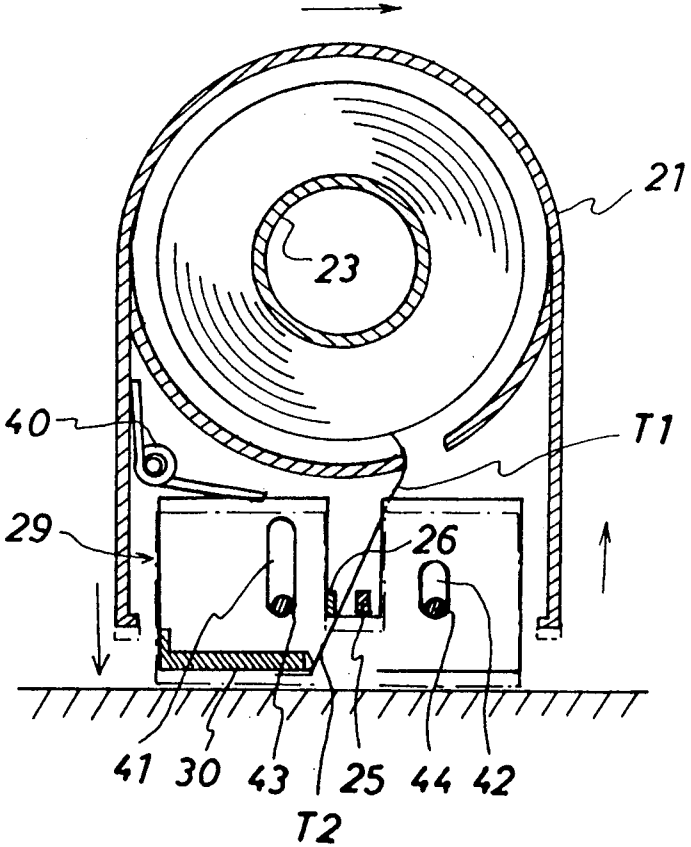
FIG. 9 is another cross-sectional view of an adhesive tape cutting device wherein operation of the movable member is modified.

FIGS. 9 and 10 are other embodiments of the tape cutting device according to this invention, wherein the device can be manually operated.

In this embodiment, the movable member 29 is energized to move downward by means of a spring 40.

This movable member 29 is provided with a pair of elongated pores, i.e. the length of a pore 41 disposed forward is relatively long, and that of a pore 42 disposed backward is relatively short.

Into these elongated pores 41, 42 are respectively fitted a pair of guide pins 43, 44 attached to the case 2 functioning as a base member.

With the engagement of these elongated pores 41, 42 with these guide pins 43, 44 attached to the case 21, the movable member 29 can be adjusted downward to work on the case 21, and is allowed to be moved up and down, or to be inclined forward.

This device can be operated in the same manner as those of the above embodiments. In addition to that, since the movable member 29 is capable of being inclined, it has become possible to more easily perform the operation of pressing the tip portion of outer delivered tape portion T2 onto a surface to be adhered.

According to the adhesive tape cutting device of this invention, the movable member is rotatably mounted relative to the base member in such a manner that the movable member takes various positions in its movement, i.e. a pressing position wherein the pressing surface portion is in parallel with the guiding edge portion, a cutting position wherein the pressing surface portion is extruded from the guiding edge portion, or a stand-by position wherein the pressing surface is retreated inside the guiding edge. Therefore, it has become possible to easily perform the operation of adhering and cutting by simply effecting displacement of the movable member relative to the guiding edge.

The adhesive tape cutting device of this invention is accordingly simple in construction, excellent in reliability and suited for mass production.

Further, since it has become possible to automatically adhere and cut the adhesive tape by simply moving the case, it can be easily handled by everybody.

Further, since the rearward end portion of the movable member is retreated into the inner side o the guiding edge thereby setting it spaced apart from the delivered tape portion, any accident of erroneously adhering the delivered tape an be avoided, thereby making it possible without fail to repeatedly perform the tape adhering operation.

I claim:

1. An adhesive tape cutting device, comprising:

a housing having an outlet;

support means mounted inside the housing for supporting an adhesive tape roll such that the tape can be unrolled and dispensed through the outlet;

guiding means for guiding unrolled tape through the outlet;

holding means disposed within the housing for temporarily holding a portion of the unrolled tape;

pressing and cutting means movably connected to the housing, the pressing and cutting means having a blade and being moveable between a standby position in which the pressing and cutting means is out of contact with the unrolled tape; a pressing position in which the pressing and cutting means presses the unrolled tape which has been dispensed through the outlet against a surface to which the unrolled tape is applied; an affixing position in which the pressing and cutting means affixes a portion of the unrolled tape to the holding means; and a cutting position in which the blade cuts the unrolled tape at a point between the holding means and the surface to which the unrolled tape is applied.

2. The device of claim 1, wherein the holding means is located between the pressing and cutting means and the outlet.

3. The device of claim 1, wherein the holding means is located between the pressing and cutting means and the support means.

4. The device of claim 1, wherein the pressing and cutting means is rotatably connected to the housing.

5. The device of claim 4, wherein the pressing and cutting means is connected to the housing by a bracket.

6. The device of claim 4, further comprising spring means for maintaining the pressing and cutting means in the standby position when the device is not in use.

7. The device of claim 1, wherein the pressing and cutting means is slidably connected to the housing such that the space between the housing and the pressing and cutting means can be varied.

8. The device of claim 1, wherein the pressing and cutting means is rotatably and slidably connected to the housing.

* * * * *